US008495772B2

(12) United States Patent
Boonstra

(10) Patent No.: US 8,495,772 B2
(45) Date of Patent: Jul. 30, 2013

(54) SHOWER DOOR EXTENSION APPARATUS

(76) Inventor: Henry J. Boonstra, Yellville, AR (US)

( * ) Notice: Subject to any disclaimer, the term of this patent is extended or adjusted under 35 U.S.C. 154(b) by 750 days.

(21) Appl. No.: 12/503,654

(22) Filed: Jul. 15, 2009

(65) Prior Publication Data

US 2010/0031438 A1 Feb. 11, 2010

Related U.S. Application Data

(60) Provisional application No. 61/081,153, filed on Jul. 16, 2008.

(51) Int. Cl.
*A47K 3/08* (2006.01)
*A47K 3/14* (2006.01)

(52) U.S. Cl.
USPC ..... 4/557

(58) Field of Classification Search
USPC ..... 4/538, 557, 596, 552, 556, 612–614, 4/610, 607, 605
See application file for complete search history.

(56) References Cited

U.S. PATENT DOCUMENTS 3,591,867 A * 7/1971 Bernstein ..... 4/579
4,365,368 A * 12/1982 Boggs ..... 4/596
4,769,949 A * 9/1988 Glendowne ..... 49/410
4,811,520 A * 3/1989 Duggan et al. ..... 49/409
4,974,269 A * 12/1990 Baus ..... 4/613
5,634,219 A * 6/1997 Paredes et al. ..... 4/558
5,867,846 A * 2/1999 Paredes et al. ..... 4/558
5,893,181 A * 4/1999 Moncaster ..... 4/557
6,023,794 A * 2/2000 Nein ..... 4/607
6,226,808 B1 * 5/2001 Walshe ..... 4/552
6,435,254 B1 * 8/2002 Todd et al. ..... 160/309
6,643,898 B1 * 11/2003 Cameron et al. ..... 16/382
6,655,444 B2 * 12/2003 Goldenberg et al. ..... 160/405
6,701,672 B2 * 3/2004 Teubert et al. ..... 49/505
6,895,714 B2 * 5/2005 Teubert et al. ..... 49/505
7,346,939 B2 * 3/2008 Perry ..... 4/557
2002/0092628 A1 * 7/2002 Todd ..... 160/309
2003/0033667 A1 * 2/2003 Lachance ..... 4/608
2005/0102746 A1 * 5/2005 Wright et al. ..... 4/555
2005/0246831 A1 * 11/2005 Mayhew et al. ..... 4/596
2006/0230519 A1 * 10/2006 Wilson et al. ..... 4/557
2006/0230526 A1 * 10/2006 Skinner ..... 4/664
2008/0289099 A1 * 11/2008 Skinner ..... 4/664

* cited by examiner

*Primary Examiner* — Lori Baker
(74) *Attorney, Agent, or Firm* — Brent A. Capehart; Capehart Law Firm

(57) ABSTRACT

A shower door apparatus is disclosed being secured to the top rim of a bath tub. The shower door apparatus has a base plate extending outward from, and beyond, the top rim of the bath tub. A shower door frame assembly having at least one shower door is secured to the base plate near the edge distal to the bath tub.

18 Claims, 5 Drawing Sheets

SHOWER DOOR EXTENSION APPARATUS

REFERENCE TO PENDING APPLICATIONS

This application claims the benefit of U.S. Provisional Patent Application, Ser. No. 61/081,153 filed Jul. 16, 2008.

REFERENCE TO MICROFICHE APPENDIX

This application is not referenced in any microfiche appendix.

BACKGROUND OF THE INVENTION

This invention relates to a shower door apparatus, and more specifically to a shower door extension apparatus that expands the usable space during the taking of a bath or shower.

The traditional shower door that is attached to a bathtub is aligned in-line with the edge of the top rim of the bath tub. This can make a user feel claustrophobic. Many people may find it difficult to wash or shave in such confined areas.

The prior art discloses a curved shower rod that allows for additional space near the top of the shower curtain. However, the effectiveness of these prior art rods is limited because such rods do not address the narrowness of the tub near the tub's rim. Thus there is a need for a more efficient and effective shower door extension apparatus.

SUMMARY OF THE INVENTION

The inventive shower door extension apparatus described herein satisfies the needs set out above. This device has an efficient design and it is effective when used.

An aspect of the present invention includes a shower door apparatus that is secured to the top rim of a bath tub. The shower door apparatus includes a base plate and shower door frame assembly. The base plate is secured to the top rim of the bathtub and extends outward and beyond the bath tub. The shower door frame assembly is secured to the base plate near the distal edge, herein referred to as the extension edge. The inclusion of the base plate and the shower door frame assembly, the usable space within a bathtub can be increased.

The extension edge can either be substantially parallel to its opposite edge, herein referred to as the bathtub edge, or can be curved. One such curvature is a concave curve relative toward the bath tub.

One aspect of the shower door frame assembly includes having a shower door frame and at least one shower door. The shower door frame can be of standard shower door frame having tracks therein to slidably engage the one or more shower doors.

One aspect of the base plate includes having a water run-off portion. This portion is located along the top surface of the base plate and is sloped downward toward said bathtub edge. The slope allows for water to run off into the bath tub.

Another aspect of the base plate includes having at least one base plate support secured to the bottom surface and said bath tub. This aspect can give additional support to the base plate.

Upon reading the included description, various alternative embodiments will become obvious to those skilled in the art. These embodiments are to be considered within the scope and spirit of the subject invention, which is only limited by the claims which follow and their equivalents.

DESCRIPTION OF THE PREFERRED EMBODIMENTS

Figure 1:
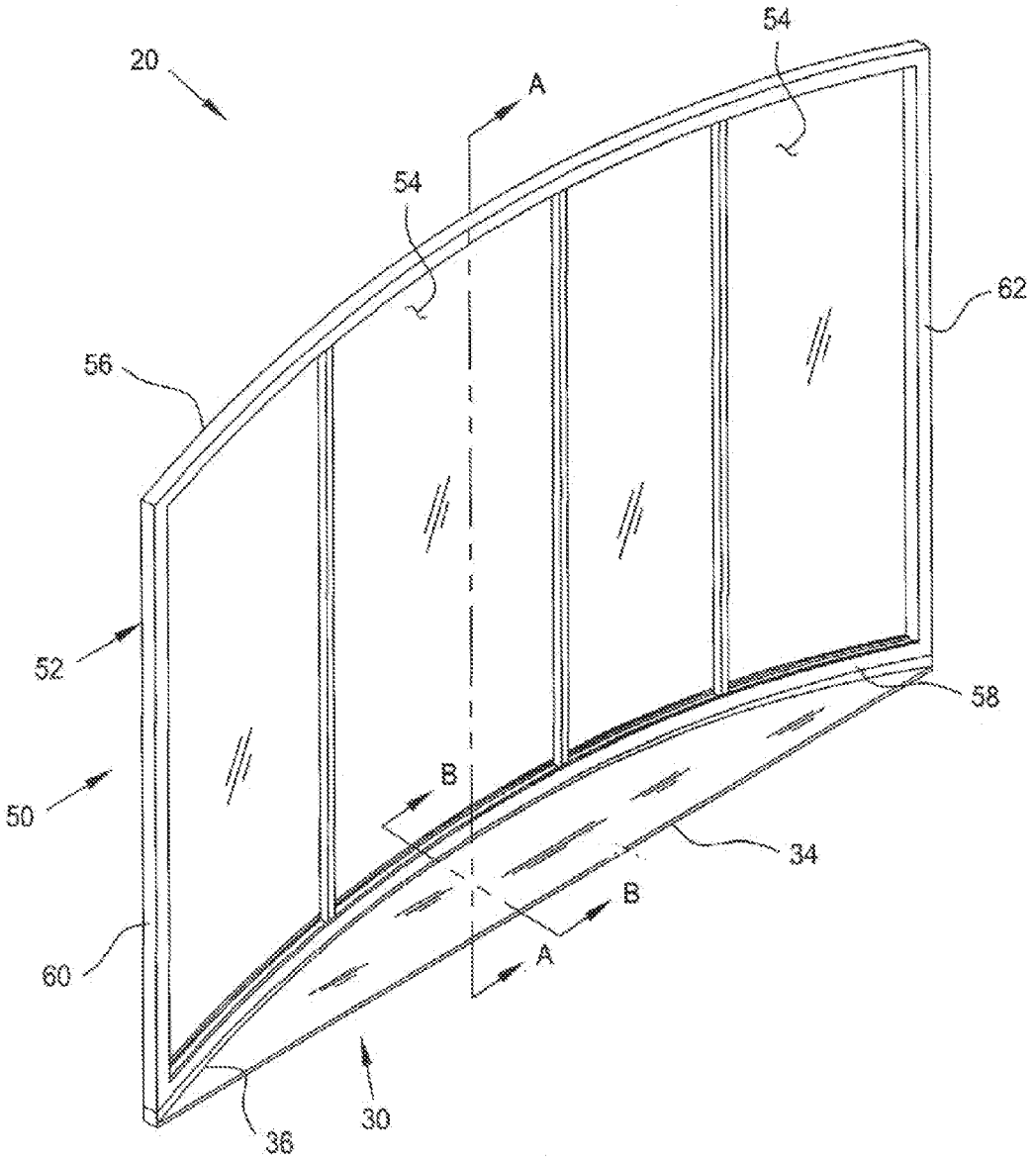
FIG. 1 is a perspective view of an embodiment of the present invention.
Figure 2:
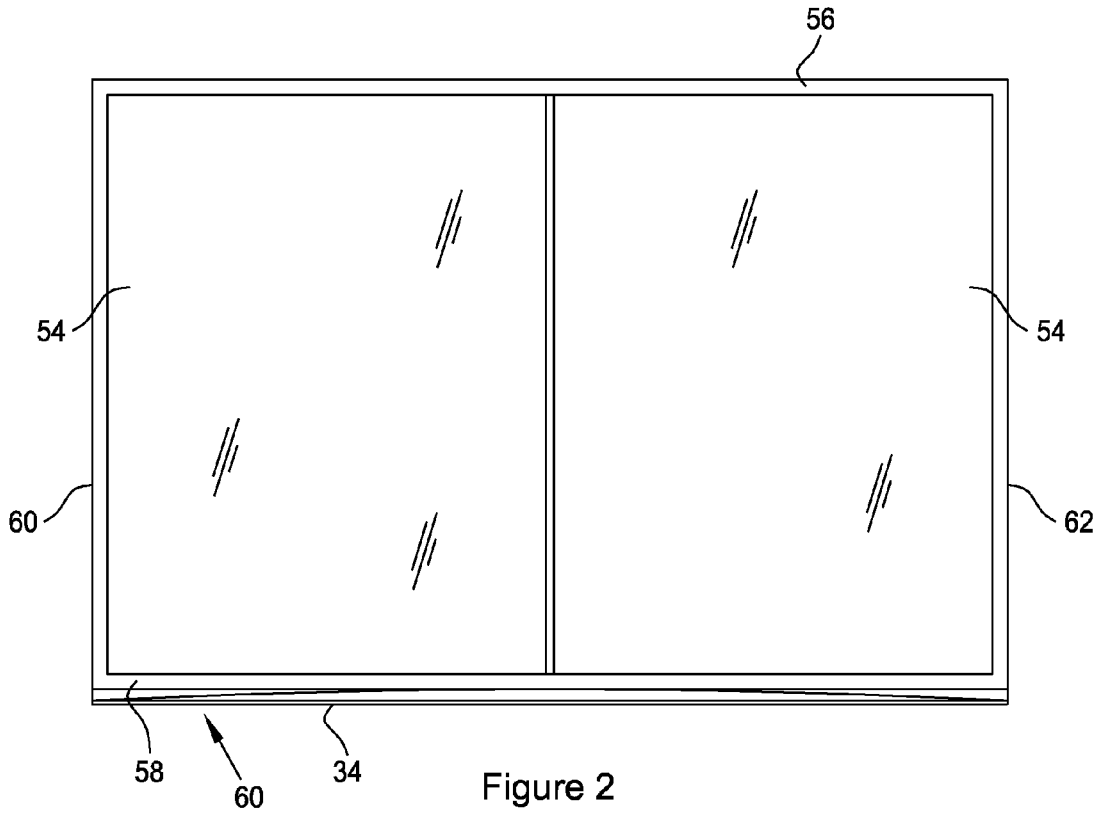
FIG. 2 is a back view of an embodiment of the present invention as shown in FIG. 1.
Figure 3:
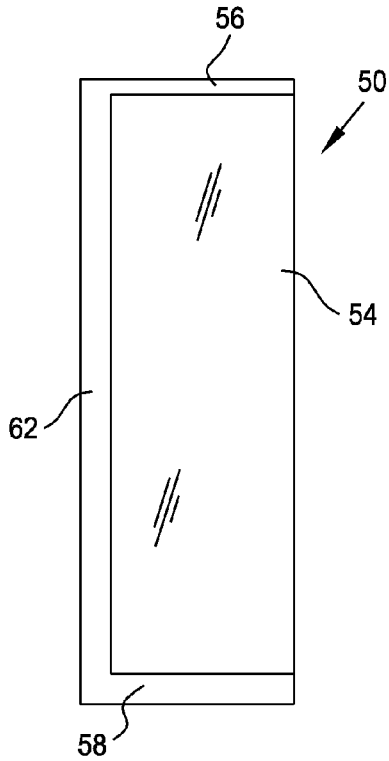
FIG. 3 is a right side view of an embodiment of the present invention as shown in FIG. 1.
Figure 4:
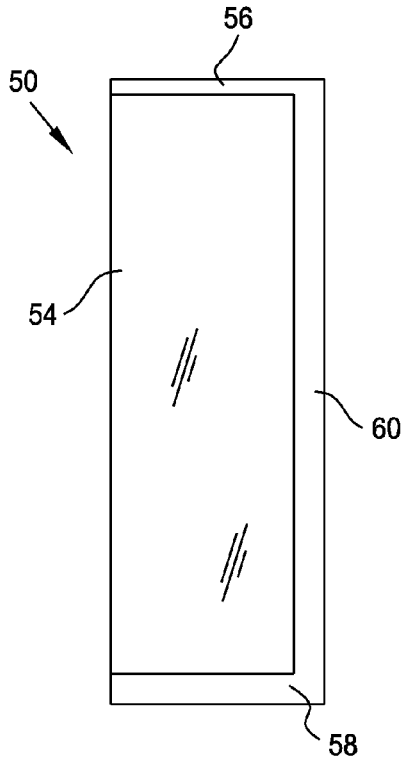
FIG. 4 is a left side view of an embodiment of the present invention as shown in FIG. 1.
Figure 5:
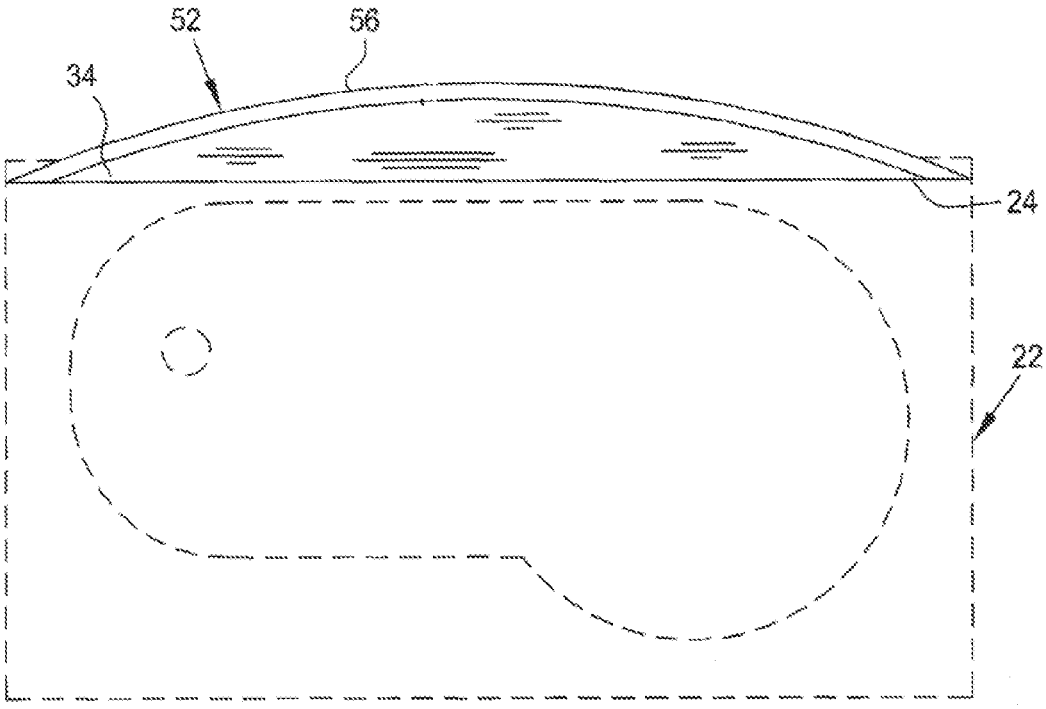
FIG. 5 is a top view of an embodiment of the present invention as shown in FIG. 1.

The following detailed description shows the best currently contemplated modes of carrying out the invention. The description is not to be taken in a limiting sense, but is made for the purpose of illustrating the general principles of the invention and the best mode for practicing the invention, since the scope of the invention is best defined by the appended claims. The invention is capable of other embodiments and of being practiced or carried out in a variety of ways. It is to be understood that the phraseology and terminology employed herein are for the purpose of description and not of limitation.

As shown by the figures, embodiments of the inventive shower door apparatus is described herein. As illustrated in FIGS. 1-8, a first embodiment of the inventive shower door apparatus 20 is shown secured to the top rim 24 of a bathtub 22. Embodiment 20 comprises a base plate 30 having a top surface 40, a bottom surface 38, a bathtub edge 34 and an extension edge 36. The portion of bottom surface 38 that is proximate to the bathtub edge 34 is secured to top rim 34 of the bathtub 22 by any form of adhesives, glues or any other known securing compound.

Base plate 30 extends outward, and beyond, bathtub 22, such that extension edge 36 is distal to bathtub 22. As illustrated by embodiment 20, extension edge 36 is shown to be curved, with such curve being concave relative to the bathtub 22. The amount of curvature can be adjusted based on the actual size of the bathtub and surrounding environment. The curvature shown in embodiment 20 is shown as a 6×60 curvature. By this it is meant that when the base plate 30 has a 60 inch length the maximum width between the extension edge 36 and the bathtub edge 34 is 6 inches. However, those skilled in the art will recognize the actual dimensions and type of curvature of this embodiment is illustrative and is not meant to be limiting.

Figure 6:
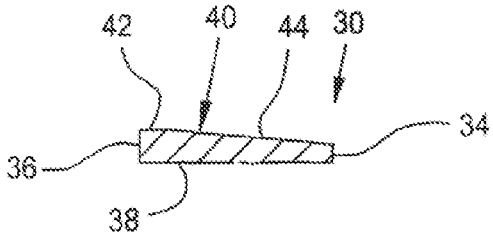
FIG. 6 is a cut-away side view of an embodiment of the base plate along line BB as shown in FIG. 1.
Figure 7:
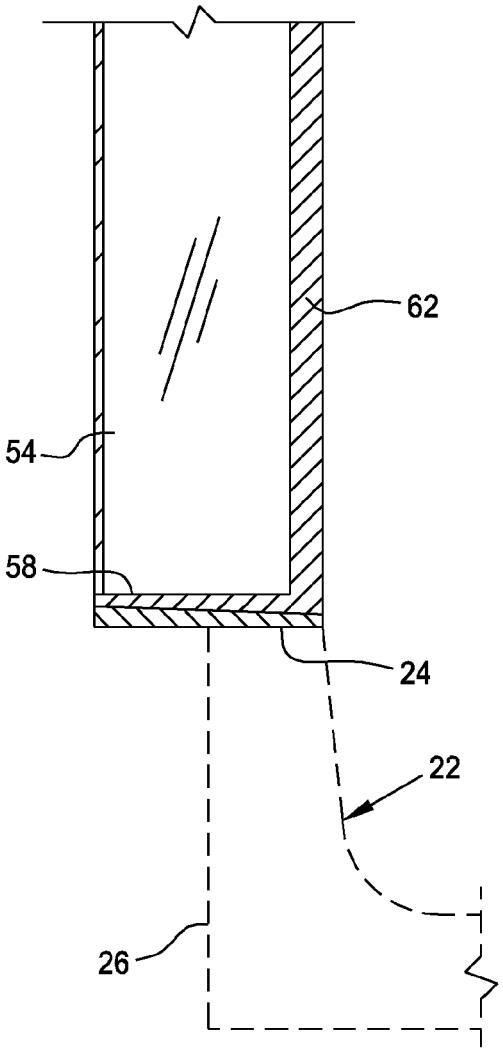
FIG. 7 is a cut-away side view of an embodiment of the present invention along line AA as shown in FIG. 1.

As shown in FIG. 6, an embodiment of the top surface 40 of base plate 30 is shown having a water run-off portion 44. This water run-off portion 44 is sloped downward toward the bathtub edge 34 to aid in the movement of water. Further, base plate 30 is shown having a shower door frame assembly mounting surface 42 located proximate the extension edge 36. The mounting surface allows for a relatively flat surface, i.e. being relatively parallel with the bottom surface 38 of the base plate 30 for the shower door frame assembly 20 to be mounted thereto while allowing for water run-off via the water run-off portion 44.

Also shown in the Figures is an embodiment of the shower door frame assembly 50. This assembly 50 is secured to the top surface 40 of base plate 30 proximate to extension edge 36. By being secured to the distal end of base plate 30, the usable space from the top rim 24 of the bathtub 22 to the top of the shower door frame assembly 20 is increased.

As illustrated, shower door frame assembly 50 comprises a shower door frame 52 and two shower doors 54. Those skilled in the art will recognize that the number of shower doors in this embodiment is illustrative and is not meant to be limiting.

Shower door frame 52 is shown comprising a top bar 56, a bottom bar 58 and first side support 60 and a second side support 62. Tracks are included therein sufficient dimensioned to allow the shower doors 54 to slidably engage the tracks.

Further, in this embodiment 20, a bottom bar 58 is secured to the top surface 40 is illustrated. The manner in which bottom bar 58 and top surface 40 are secured can be by adhesives, snap-rivets, or any other manner of securing these items together.

Figure 8:
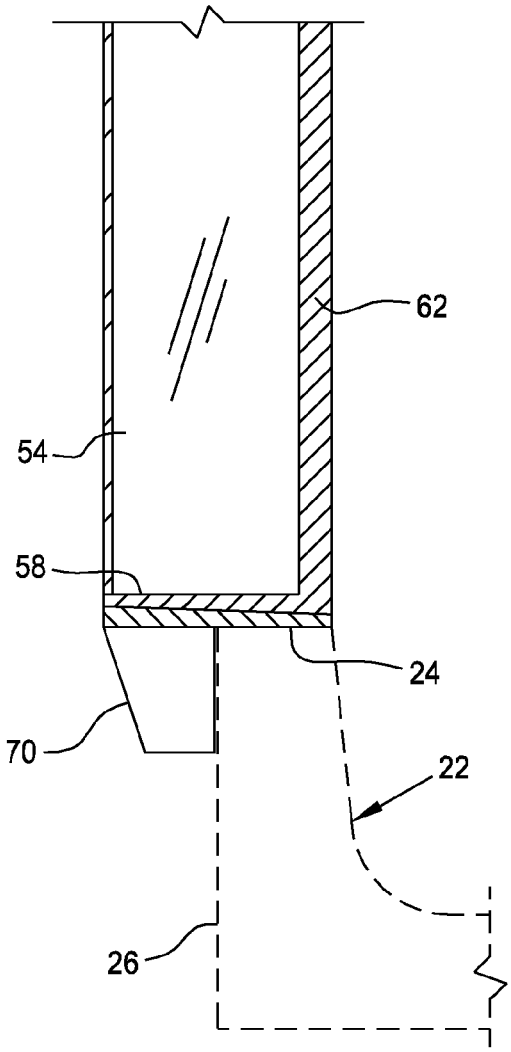
FIG. 8 is a cut-away side view of an embodiment of the present invention along line AA as shown in FIG. 1 showing an embodiment of a base plate support.

As illustrated in FIG. 8, an optional base plate support 70 is shown. This base plate support 70 is secured to the bottom surface 38 of base plate 30 and in contact with the outer surface of bathtub 22.

Figure 9:
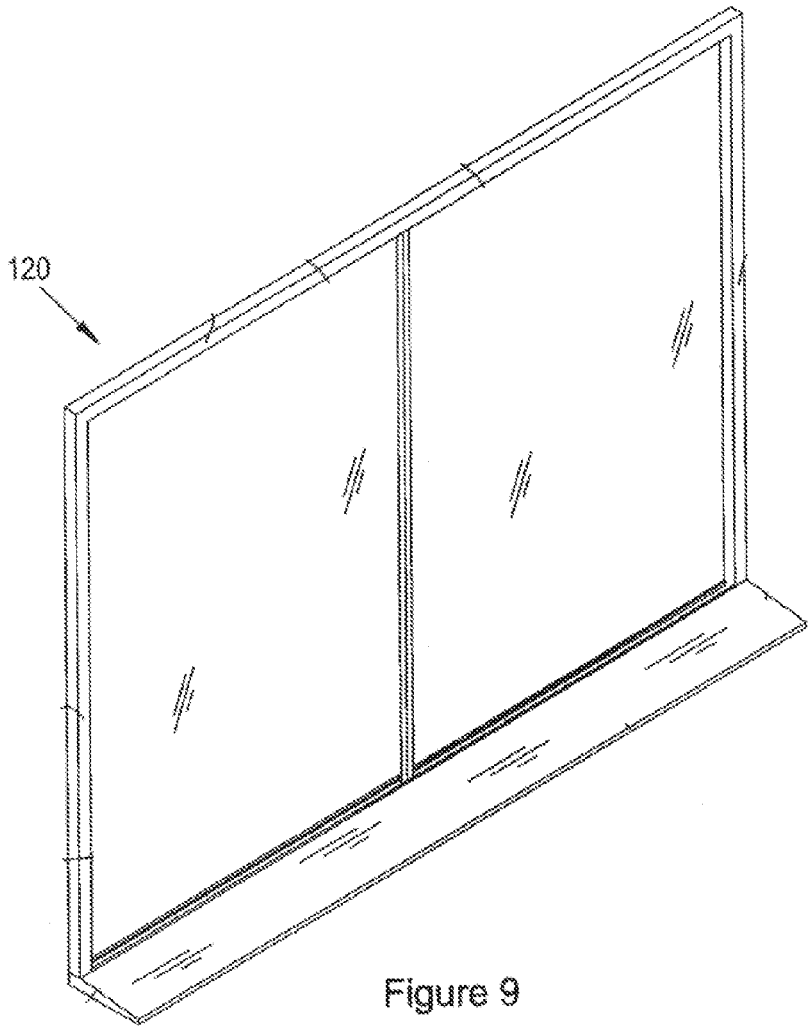
FIG. 9 is a perspective view of an additional embodiment of the present invention.
Figure 10:
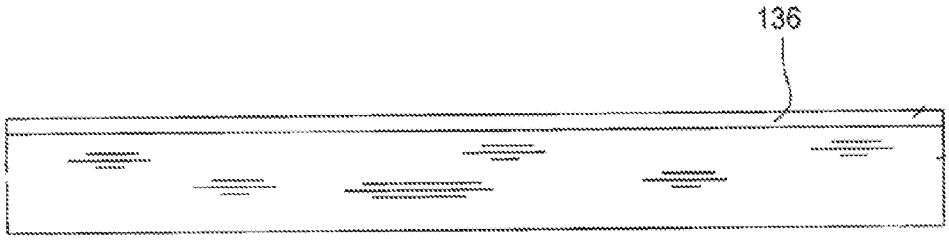
FIG. 10 is a top view of an embodiment of the present invention as shown in FIG. 9.
Figure 11:
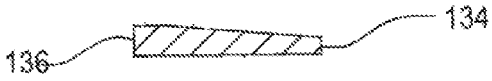
FIG. 11 is a side view of an embodiment of the base plate as shown in FIG. 9.

As illustrated by FIGS. 9-11, a second embodiment 120 discloses the inventive shower door apparatus as set out above but having an extension edge 136 that is substantially parallel to bathtub edge 134.

While embodiments of the present invention have been illustrated and described, such disclosures should not be regarded as any limitation of the scope of our invention. The true scope of our invention is defined in the appended claims. Therefore, it is intended that the appended claims shall be construed to include both the preferred embodiment and all such variations and modifications as fall within the spirit and scope of the invention.

I claim:

1. A shower door apparatus secured to the top rim of a bath tub, said shower door apparatus comprising:

a base plate having a top surface, a bottom surface, a bathtub edge and an extension edge, said bottom surface proximate said bathtub edge being secured to said top rim of said bathtub, said base plate extending outward and beyond the bath tub such that said extension edge of said base plate is distal to said bath tub for support; and a shower door frame assembly secured to said top surface of said base plate proximate said extension edge of said base plate, thereby increasing the usable space within the bath tub.

2. The shower door apparatus of claim 1 wherein said extension edge is further defined as having a concave curvature, said concave curvature being relative to said bath tub.

3. The shower door apparatus of claim 1 wherein said extension edge is further defined as being substantially parallel to said bathtub edge.

4. The shower door apparatus of claim 1 wherein said top surface of said base plate is further defined as having a water run-off portion, said water run-off portion being sloped downward toward said bathtub edge to aid in the movement of water.

5. The shower door apparatus of claim 4 wherein said top surface of said base plate is further defined as having a shower door frame assembly mounting surface proximate said extension edge and between said extension edge and said water run-off portion.

6. The shower door apparatus of claim 5 wherein said shower door frame assembly mounting surface of said top surface is further defined as being substantially parallel to said bottom surface of said base plate.

7. The shower door apparatus of claim 1 wherein said shower door frame assembly is further defined as having a shower door frame and at least one shower door.

8. The shower door apparatus of claim 7 wherein said shower door frame is further defined as having a top bar, a bottom bar and two side supports therebetween, said top bar, bottom bar and two side supports having tracks therein dimensioned sufficient to allow said at least one shower door to slidably engage said tracks.

9. The shower door apparatus of claim 8 wherein said bottom bar of said shower door being secured to said base plate.

10. The shower door apparatus of claim 1 further comprising at least one base plate support secured to said bottom surface of said base plate and in contact with the outer surface of said bath tub.

11. A shower door apparatus secured to the top rim of a bath tub, said shower door apparatus comprising:

a base plate having a top surface, a bottom surface, a bathtub edge and an extension edge, said base plate extending outward and beyond the bath tub such that said extension edge is distal to said bath tub;

said top surface having a water run-off portion, said water run-off portion being sloped downward toward said bathtub edge to aid in the movement of water, said bottom surface proximate said bathtub edge being secured to said top rim of said bathtub and, said extension edge having a concave curvature, said concave curvature being relative to said bath tub; and a shower door frame assembly secured to said top surface of said base plate proximate said extension edge, said shower door frame assembly is further defined as having a shower door frame and at least one shower door thereby increasing the usable space within the bath tub.

12. The shower door apparatus of claim 11 further comprising at least one base plate support secured to said bottom surface and said bath tub.

13. The shower door apparatus of claim 11 wherein said shower door frame is further defined as having a top bar, a bottom bar and two side supports therebetween, said top bar, bottom bar and two side supports having tracks therein dimensioned sufficient to allow said at least one shower door to slidably engage said tracks and wherein said bottom bar of said shower door being secured to said top surface of said base plate.

14. The shower door apparatus of claim 11 wherein said top surface of said base plate is further defined as having a shower door frame assembly mounting surface proximate said extension edge and between said extension edge and said water run-off portion.

15. The shower door apparatus of claim 14 wherein said bottom bar of said shower door being secured to said shower door frame assembly mounting surface of said top surface.

16. In combination a bathtub and shower door apparatus comprising:

a bathtub having a top rim;

an base plate having a top surface, a bottom surface, a bathtub edge and an extension edge, said base plate extending outward and beyond the bath tub such that said extension edge is distal to said bath tub, said bottom surface proximate said bathtub edge being secured to said top rim of said bathtub; and a shower door frame assembly secured to said top surface of said base plate proximate said extension edge thereby increasing the usable space within the bath tub.

17. The shower door apparatus of claim 1 wherein the base plate has a 60 inch maximum length and the maximum width between the extension edge of the base plate and the bath tub is 6 inches.

18. The shower door apparatus of claim 11 further comprising at least one base plate support secured to said bottom surface of said base plate and in contact with the outer surface of said bath tub.

* * * * *